US009062646B2

(12) United States Patent
Kuwada et al.

(10) Patent No.: US 9,062,646 B2
(45) Date of Patent: Jun. 23, 2015

(54) STARTER

(71) Applicant: DENSO CORPORATION, Kariya, Aichi-pref. (JP)

(72) Inventors: Akina Kuwada, Kariya (JP); Takuma Koudu, Kariya (JP)

(73) Assignee: DENSO CORPORATION, Kariya (JP)

( * ) Notice: Subject to any disclaimer, the term of this patent is extended or adjusted under 35 U.S.C. 154(b) by 399 days.

(21) Appl. No.: 13/644,248

(22) Filed: Oct. 3, 2012

(65) Prior Publication Data

US 2013/0167686 A1 Jul. 4, 2013

(30) Foreign Application Priority Data

Oct. 7, 2011 (JP) ..... 2011-222496

(51) Int. Cl.

*F02N 11/02* (2006.01)
*F02N 15/02* (2006.01)
*F02N 15/06* (2006.01)
*F02N 15/04* (2006.01)

(52) U.S. Cl.

CPC ..... *F02N 11/02* (2013.01); *F02N 15/023* (2013.01); *F02N 15/046* (2013.01); *F02N 15/067* (2013.01); *F02N 2015/061* (2013.01)

(58) Field of Classification Search

CPC ..... F02N 11/02; F02N 15/067; F02N 15/023; F02N 2015/061; F02N 15/046
USPC ..... 74/6, 7 R, 7 E, 8, 9
See application file for complete search history.

(56) References Cited

U.S. PATENT DOCUMENTS 3,399,576 A * 9/1968 Seilly ..... 74/7 R
4,488,054 A * 12/1984 Ebihara ..... 290/38 A
4,587,861 A * 5/1986 Morishita ..... 74/7 E
4,590,811 A * 5/1986 Kasubuchi ..... 74/7 E
4,931,663 A * 6/1990 Morishita et al. ..... 290/48
4,958,097 A * 9/1990 Woodward et al. ..... 310/83
5,265,485 A * 11/1993 Sakamoto et al. ..... 74/7 E (Continued)

FOREIGN PATENT DOCUMENTS

CN 101573528 A 11/2009
JP S41-012648 10/1964

(Continued)

OTHER PUBLICATIONS

Chinese Office Action issued in Chinese Patent Application No. 201210376270.3 on Oct. 8, 2014 (with translation).

(Continued)

*Primary Examiner* — David M Fenstermacher
(74) *Attorney, Agent, or Firm* — Oliff PLC

(57) ABSTRACT

In a starter, an output shaft is supported by a main tube body according to a direct contacting structure that outer surfaces other than a male helical spline and inner surfaces other than a female helical spline of a pinion tube contact directly. Thereby, the output shaft can be supported by the pinion tube without other parts. As a result, a clearance that occurs in a radial direction can be limited to a clearance in the radial direction formed between an outer surfaces of the output shaft and an inner surfaces of the pinion tube regarding a support of the output shaft by the pinion tube, and since an inclination of the pinion tube and the pinion relative to the output shaft can be suppressed, a life improvement effect of the starter can be enhanced.

12 Claims, 6 Drawing Sheets

(56) References Cited

U.S. PATENT DOCUMENTS

| | | | | |
|---|---|---|---|---|
| 5,610,466 | A * | 3/1997 | Shiga et al. | 310/239 |
| 5,895,993 | A | 4/1999 | Kajino et al. | |
| 5,898,229 | A | 4/1999 | Murata et al. | |
| 6,813,967 | B2 * | 11/2004 | Andou | 74/7 A |
| 7,814,807 | B2 * | 10/2010 | Hirabayashi | 74/352 |
| 7,859,150 | B2 * | 12/2010 | Utsunomiya et al. | 310/75 R |
| 7,980,150 | B2 * | 7/2011 | Hasegawa et al. | 74/7 E |
| 8,215,194 | B2 * | 7/2012 | Hirai et al. | 74/6 |
| 2006/0144177 | A1 | 7/2006 | Andoh | |
| 2008/0227556 | A1 | 9/2008 | Andoh et al. | |
| 2013/0021038 | A1 | 1/2013 | Tago et al. | |

FOREIGN PATENT DOCUMENTS

| | | | |
|---|---|---|---|
| JP | S58-053943 | U | 4/1983 |
| JP | 2001-065587 | A | 3/2001 |
| JP | A-2006-177168 | | 7/2006 |
| JP | A-2007-146759 | | 6/2007 |
| JP | 2008-223633 | A | 9/2008 |
| JP | A-2013-40918 | | 2/2013 |

OTHER PUBLICATIONS

Apr. 14, 2015 Office Action issued in Japanese Application No. 2011-222496.

* cited by examiner (STOPPED STATE)

(DRIVING STATE)

X1 or X2 < Y

X1 and X2 > Z

STARTER

CROSS-REFERENCE TO RELATED APPLICATION

This application is based on and claims the benefit of priority from earlier Japanese Patent Application No. 2011-222496 filed Oct. 7, 2011, the description of which is incorporated herein by reference.

TECHNICAL FIELD

The present disclosure relates to a starter that has a system of having a pinion tube that meshes with a perimeter of an output shaft in a spline fitting manner, and a pinion supported by an end of the pinion tube in an anti-motor side in an axial direction is meshed with an engine ring gear by pushing out the pinion tube in an anti-motor side direction relative to the output shaft.

BACKGROUND

Conventionally, a starter with a cantilever structure is disclosed in Japanese Patent Application Laid-Open Publication No. 2006-177168.

The starter includes an output shaft 100, a pinion tube 120, a one-way clutch 130, a pinion 140, and a housing 160, as shown in FIG. 5.

The output shaft 100 is driven by a motor (not shown), and the pinion tube 120 is fit to a perimeter of the output shaft 100 via bearings 110.

The one-way clutch 130 is of a roller type that transmits rotation of the output shaft 100 to the pinion tube 120, and the pinion 140 is meshed with an end of the pinion tube 120 in an anti-motor side in an axial direction (left-hand side in the drawings) in a direct spline fitting manner.

The housing 160 supports the pinion tube 120 through a bearing 150 disposed between the clutch 130 and the pinion 140.

This starter has a system that pushes out the pinion tube 120 together with the clutch 130 in the anti-motor side direction (left-hand side in the drawing) relative to the output shaft 100, and engages the pinion 140 to an engine ring gear when triggered by an electromagnetic switch (not shown).

The starter mentioned above has a composition that the clutch 130 moves together with the pinion tube 120 when pushing out the pinion tube 120 in the anti-motor side direction by the electromagnetic switch.

Therefore, the moving mass of the movable bodies (the pinion tube 120, the clutch 130, the pinion 140) has become large and this has been a target for miniaturizing the electromagnetic switch.

On the other hand, there is a starter having a cantilever structure disclosed in Japanese Patent Application Laid-Open Publication No. 2007-146759.

In this starter, as shown in FIG. 6, the pinion shaft 170 is disposed in a helical spline fitting manner movable in an axial direction to the inner tube 131 of the clutch 130, and the pinion 140 is attached to an end of the pinion shaft 170 on an anti-motor side in the axial direction.

With this composition, since the clutch 130 does not move when pushing out the pinion shaft 170 in the anti-motor side direction by the electromagnetic switch, as compared with the starter of '168, the moving mass of the movable bodies (the pinion shaft 170, the pinion 140) can be made small.

As a result, it is possible to attain the miniaturization of the electromagnetic switch that generates the attraction force for pushing out the movable bodies.

In recent years, vehicles employing an idling stop system (ISS) that stops fuel injection to an engine to stop the engine automatically when the vehicle stops at a traffic light or during a traffic jam, etc. are increasing.

In the vehicles that employ the ISS, as compared with the vehicles that do not employ the ISS, the frequency of starting the engine increases sharply, while a number of times of operating the starter also increases sharply.

As more and more vehicles are using ISS, there is high demand for starters having well-aligned output shafts 100 and pinion tubes 120, to extend the life of the starter.

SUMMARY

An embodiment provides a starter with a cantilever structure that suppresses an inclination of a pinion tube or a pinion relative to an output shaft and extends the life of the starter.

In a starter according to a first aspect, the starter includes an output shaft disposed coaxially with a rotating shaft of the motor, a male spline formed on an outer surface of the output shaft, a clutch that transmits the torque generated by the motor to the output shaft, a pinion tube that has a cylindrical hole where a female spline is formed in an inner surface thereof and an anti-motor side in an axial direction of the output shaft is inserted into an inner circumference of the cylindrical hole so that the male spline and the female spline are meshed, a pinion disposed on an end of the pinion tube in the anti-motor side in the axial direction and which rotates together with the pinion tube, and an electromagnetic solenoid that drives a shift lever by an attraction force of an electromagnet and pushes out the pinion tube together with the pinion in the anti-motor side direction relative to the output shaft via the shift lever.

The pinion is engaged with a ring gear of an engine by pushing out the pinion tube in the anti-motor side direction relative to the output shaft by an operation of the electromagnetic solenoid. The output shaft is supported by the pinion tube using a direct contacting structure that directly contacts outer surfaces other than the male spline and inner surfaces other than the female spline of the pinion tube.

By this, since the output shaft can be supported by the pinion tube without other parts, such as bearings, a clearance that occurs in the radial direction can be limited to the radial direction clearance formed between the sliding surface that is the outer surfaces of the output shaft and the sliding surface that is the inner surfaces of the pinion tube.

For this reason, regarding the support of the output shaft by the pinion tube, since the clearance in the radial direction can be configured to be small, the inclination of the pinion tube or the pinion relative to the output shaft can be suppressed, and the life of the starter can be extended.

Moreover, since the output shaft can be supported by the pinion tube by both meshing of the male and the female helical splines and the direct contacting structure, the inclination of the pinion tube and the pinion relative to the output shaft can further be suppressed.

That is, since the direct contacting structure is formed by outer surfaces other than the male helical spline and inner surfaces other than the female helical spline contacting directly, the direct contacting structure and meshing of the male and the female splines do not overlap in the axial direction but are formed separated in the axial direction.

For this reason, since the output shaft can be supported by the pinion tube according to two structures separated in the axial direction (i.e., the direct contacting structure and meshing of the male and the female splines), the inclination of the pinion tube and the pinion relative to the output shaft can further be suppressed.

In the starter according to a second aspect, when a distance between a tooth tip of the male spline and a tooth bottom of the female spline in a radial direction is defined as an outer surface inter-tooth distance, and a distance between a tooth bottom of the male spline and a tooth tip of the female spline in a radial direction is defined as an inner surface inter-tooth distance, at least one of the inter-tooth distances (i.e. in the inner or outer surface) is smaller than a backlash between the male spline and the female spline in a circumferential direction.

In addition, a clearance in a radial direction between the inner surface of the pinion tube and the outer surface of the output shaft is configured smaller than both the inter-tooth distances in the outer surface and the inner surface.

In the starter according to a third aspect, the inner surface of the pinion tube is formed in the anti-motor side in the axial direction of the female spline, and the outer surface of the output shaft is formed in the anti-motor side in the axial direction from the male spline.

In the starter according to a fourth aspect, a diameter of the tooth bottom of the male spline is smaller than that of the outer surface of the output shaft.

In the starter according to a fifth aspect, a slot where lubricant is filled is formed on at least one of the outer surface of the output shaft and the inner surface of the pinion tube.

DETAILED DESCRIPTION OF THE PREFERRED EMBODIMENTS

With reference to the drawings, hereinafter will be described an embodiment of the present disclosure.

Figure 1:
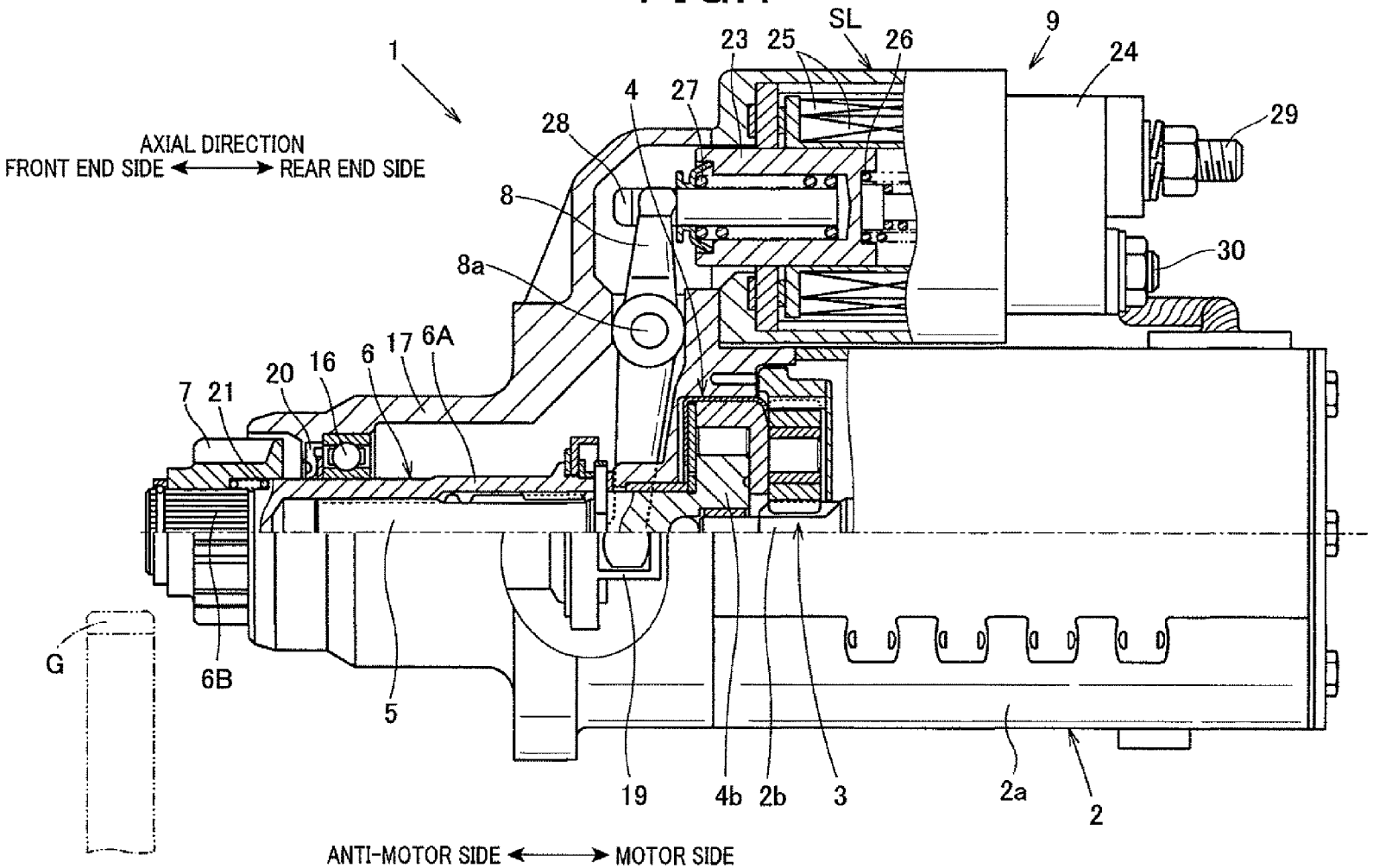
FIG. 1 shows a block diagram showing an entire starter.

As shown in FIG. 1, a starter 1 includes a motor 2, a speed reducer 3, an output shaft 5, a pinion tube 6, a pinion 7, and an electromagnetic switch 9.

The motor 2 generates torque and its rotation speed is slowed down by the speed reducer 3.

The output shaft 5 is connected with an output side of the speed reducer 3 through a clutch 4, and the pinion tube 6 is meshed in a spline fitting manner to an outer perimeter of the output shaft 5.

The pinion 7 is attached to an end in an anti-motor side in an axial direction of the pinion tube 6, and rotates together with the pinion tube 6.

The electromagnetic switch 9 drives a shift lever 8 by an attraction force of an electromagnet, and pushes out the pinion tube 6 together with the pinion 7 relative to the output shaft 5 through the shift lever 8.

Moreover, the electromagnetic switch 9 opens and closes a main point of contact, which is mentioned later, and intermits an energizing current of the motor 2.

Here, a motor side in the axial direction (right-hand side in the drawing) is defined as a rear end side, and an anti-motor side in the axial direction (a side opposite to the motor 2) is defined as a front end side in the following explanation.

Moreover, a direction where the pinion tube 6 is pushed out by the electromagnetic switch 9 relative to the output shaft 5 (left-hand side in the drawing) is defined as an anti-motor side direction, and a direction where the pinion tube 6 is pushed back is defined as a motor side direction.

The motor 2 is a direct-current commutator motor, for example, that includes a magnetic field constituted by arranging a permanent magnet (a field coil may be sufficient) in an inner circumference of a yoke 2*a* that serves as a frame, an armature (not shown) that has a commutator (not shown) on an outer surface of an armature shaft 2*b*, and a brush (not shown) disposed on an outer surface of the commutator.

The motor 2 generates torque in the armature by an interaction with the magnetic field when the main point of contact is closed by the electromagnetic switch 9 and the armature is energized.

Figure 2A:
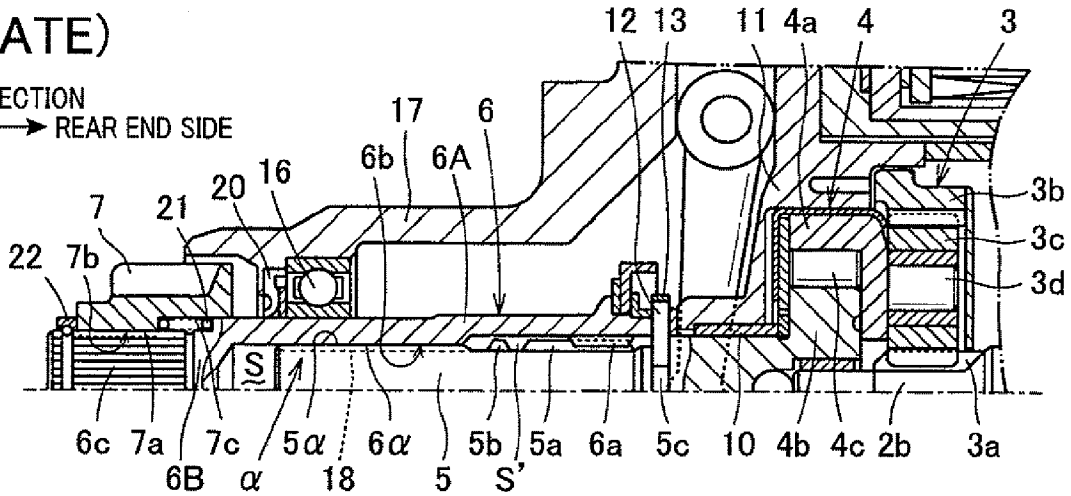
FIG. 2A shows a block diagram showing a principal part of FIG. 1 when a motor is stopped.
Figure 2B:
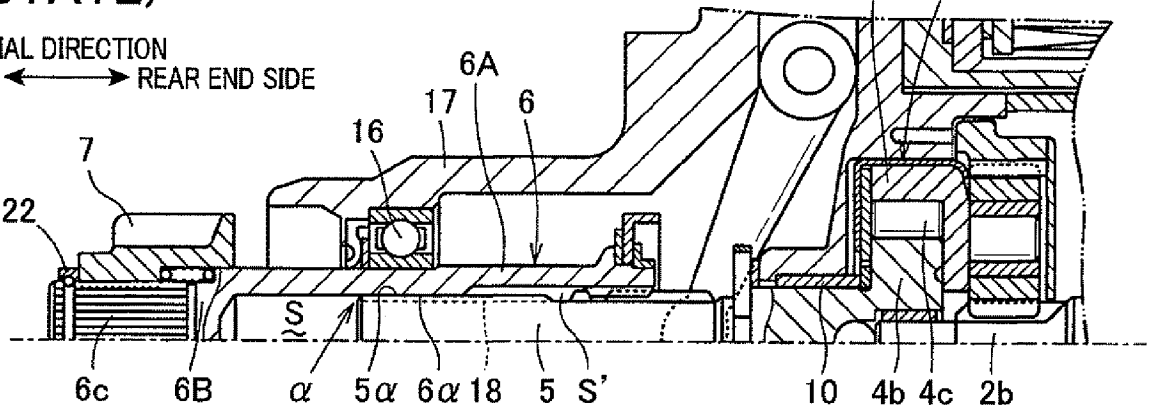
FIG. 2B shows a block diagram showing a principal part of FIG. 1 when the motor is driven.

The speed reducer 3 has a sun gear 3*a* disposed on an anti-commutator side (left-hand side in the drawing) of the armature shaft 2*b*, a ring-shaped internal gear 3*b* arranged coaxially with the sun gear 3*a*, and a plurality of (for example, three) planetary gears 3*c* that mesh with the sun gear 3*a* and the internal gear 3*b*, as shown in FIGS. 2A and 2B.

The speed reducer 3 is a planetary gear speed reducer such that the planetary gears 3*c* rotate and revolve around the sun gear 3*a* in accordance with a rotation of the sun gear 3*a*.

The clutch 4 includes an outer 4*a* disposed together with gear shafts 3*d* that rotatably support the planetary gears 3*c* of the speed reducer 3, an inner 4*b* disposed relatively rotatable to an inner circumference of the outer 4*a*, and rollers 4*c* (power intermittence member of the present disclosure) disposed between the outer 4*a* and the inner 4*b*, as shown in FIGS. 2A and 2B.

The clutch 4 is a one-way clutch that transmits running torque to the inner 4*b* from the outer 4*a* through the rollers 4*c*, while intercepts the torque transmission from the inner 4*b* to the outer 4*a* because the rollers 4*c* idle.

As shown in FIG. 2, the output shaft 5 is disposed coaxially with the armature shaft (rotating shaft) 2*b* of the motor 2.

An end of the output shaft 5 in the rear end side (right-hand side in the drawing) is disposed together with the inner 4*b* of the clutch 4, and the outer surface of the output shaft 5 is rotatably supported by a center case 11 through a bearing 10.

Moreover, a male helical spline 5*a* is formed on the outer surface of the output shaft 5 in the front end side of the outer surface where is supported by the bearing 10, and a stopper 5*b* that suppresses a maximum advanced position of the pinion tube 6 is formed on a front end surface in the front end side of the male helical spline 5*a*.

Further, a circumferential slot 5*c* is recessed in all the circumferences between the outer surface that is supported by the bearing 10 of the output shaft 5 and the male helical spline 5*a*, and a stopper member 12 that suppresses a stopping position of the pinion tube 6 in the circumferential slot 5*c* is attached.

The stopper member 12 is an E-clip, for example, and the E-clip is used by inserting it in the perimeter of the circumferential slot 5*c*.

In addition, two or more sheets of the E-clip may be used.

Moreover, a cover 13 may be put on the perimeter of the E-clip so that the E-clip may not come off from the circumferential slot 5*c* by the centrifugal force that occurs when the output shaft 5 rotates.

As shown in FIG. 2, the pinion tube 6 has a main tube body 6A that has a cylindrical hole 6*b* where a female helical spline 6*a* is formed in an inner surface thereof, and a pinion sliding part 6B disposed in the front end side from the main tube body 6A.

As for the pinion tube 6, an outer surface of the main tube body 6A is supported by a housing 17 through a bearing 16 slidably in the axial direction.

Moreover, the output shaft 5 is inserted into the inner circumference of the cylindrical hole 6*b*, and the female helical spline 6*a* meshes with the male helical spline 5*a*.

Thereby, the pinion tube 6 is attached to be rotatable and movable in the axial direction relative to the output shaft 5.

The maximum advanced position of the pinion tube 6 mentioned above is suppressed since the front end side of the female helical spline 6*a* contacts the rear end side of the stopper 5*b*.

In addition, although a ball bearing is used for the bearing 16, a slide bearing (plain bearing) or a needle bearing may be used in FIG. 1 and FIG. 2.

An inner diameter of the cylindrical hole 6*b* of the main tube body 6A differs in the front end side and rear end side from an approximately central part thereof in the axial direction. The inner diameter in the rear end side is formed larger than that of the front end side, and the female helical spline 6*a* is formed on the inner surface in the rear end side.

The inner diameter in the rear end side of the cylindrical hole 6*b* is formed approximately the same size as a tooth bottom diameter of the female helical spline 6*a*.

Figure 3A:
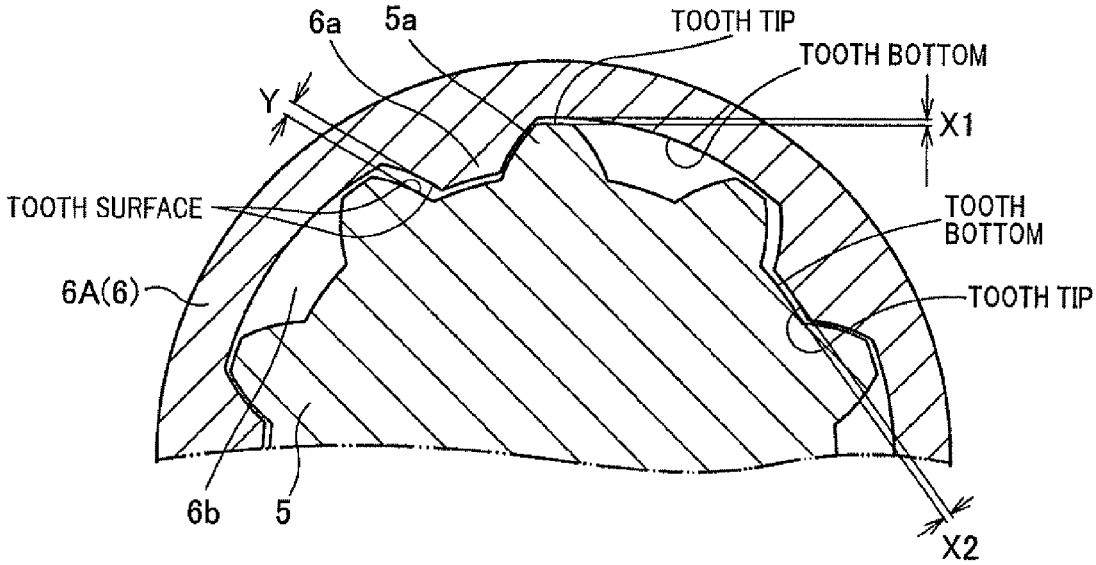
FIG. 3A shows a diagram explaining distances between teeth in an outer surface and an inner surface, and a backlash between a male spline and a female spline in a circumferential direction.
Figure 3B:
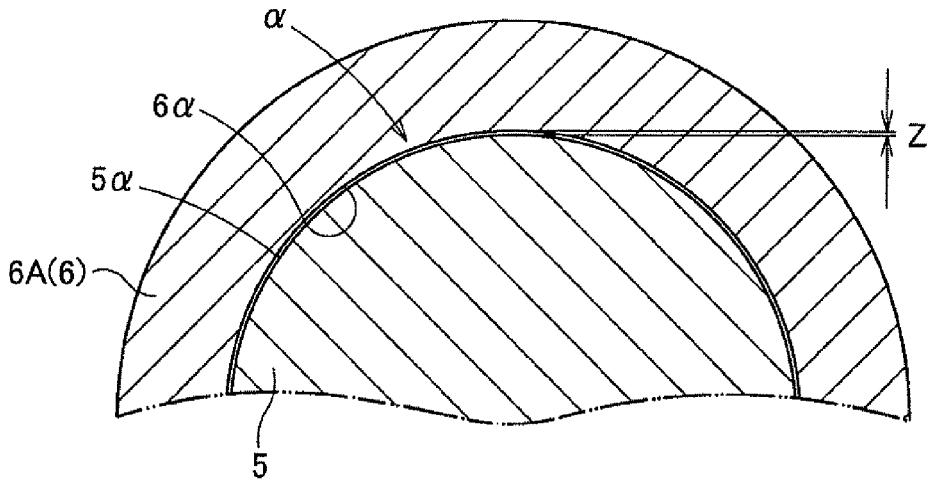
FIG. 3B shows a diagram showing a clearance in a radial direction in a direct contacting structure.

Moreover, as shown in FIGS. 3A and 3B, when a distance between a tooth tip of the male helical spline 5*a* and the tooth bottom of the female helical spline 6*a* in a radial direction is defined as a distance X1 between the teeth in the outer surface, and a distance between the tooth bottom of the male helical spline 5*a* and a tooth tip of the female helical spline 6*a* in a radial direction is defined as a distance X2 between the teeth in the inner surface, both distances X1 and X2 between the teeth in the inner surface and the outer surface are smaller than a backlash Y between the male helical spline 5*a* and the female helical spline 6*a* in a circumferential direction.

In addition, a number of teeth of the male helical spline 5*a* is twice a number of teeth of the female helical spline 6*a*.

For this reason, when the female helical spline 6*a* is meshed with the male helical spline 5*a*, two teeth of the male helical spline 5*a* enter between the teeth of the female helical spline 6*a*.

Moreover, the output shaft 5 is supported by the main tube body 6A according to a direct contacting structure a that outer surfaces other than the male helical spline 5*a* and inner surfaces other than the female helical spline 6*a* of the pinion tube 6 contact directly (refer to FIGS. 2A, 2B, 3A and 3B).

That is, in the front end side of the cylindrical hole 6*b*, a clearance Z in a radial direction between the inner surface (inner surface of the pinion tube 6) of the cylindrical hole 6*b* and the outer surface of the output shaft 5 is configured smaller than both the distances X1 and X2 between the teeth in the outer surface and the inner surface.

Moreover, the outer surface of the output shaft 5 and the inner surface of the pinion tube 6 form sliding surfaces 5*a* and 6*a* that slidably touch each other in the axial direction and in the circumferential direction, respectively.

That is, in the front end side of the cylindrical hole 6*b*, the output shaft 5 is supported by the pinion tube 6 forming a clearance Z between the pinion tubes 6 in the radial direction.

Here, the sliding surface 6*a* in the pinion tube 6 side that forms the direct contacting structure a is formed in the front end side of the female helical spline 6*a*, and the sliding surface 5*a* in the output shaft 5 side that forms the direct contacting structure a is formed in the front end side of the male helical spline 5*a*.

Figure 4A:
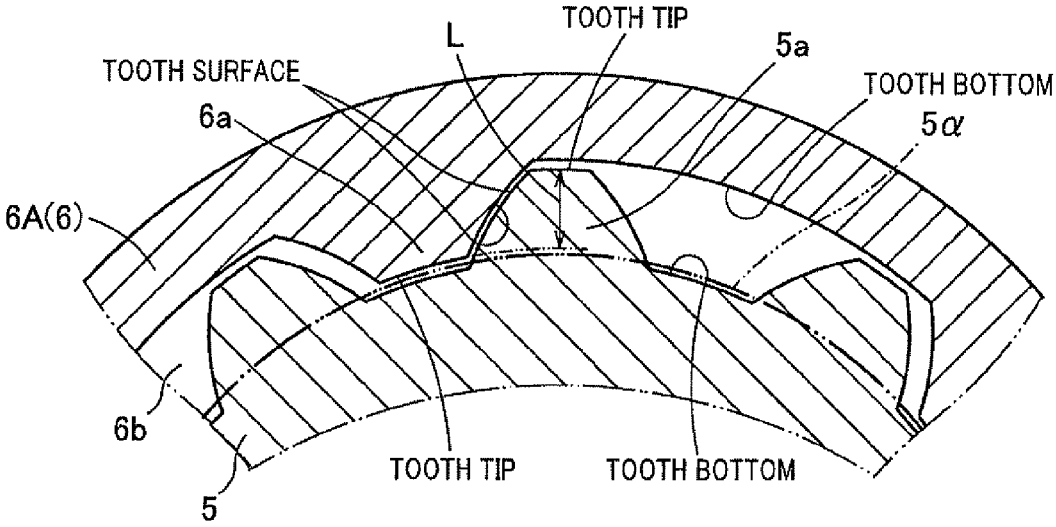
FIG. 4A shows a diagram showing a spatial relationship between an outer surface of an output shaft and a tooth bottom of the male spline in the radial direction that forms the direct contacting structure of the present disclosure.

Moreover, a diameter of the tooth bottom of the male helical spline 5*a* is smaller than that of the sliding surface 5*a*, as shown in FIG. 4A.

Furthermore, from the time when the starter is stopped shown in FIG. 2A till the time when the starter is driven shown in FIG. 2B, a communicating slot 18 that communicates a space S formed between a tip surface (an end face in the front end side) of the output shaft 5 and a bottom in the axial direction of the cylindrical hole 6*b* (that is, the space S formed in the front end side of the direct contacting structure a), and a space S' in the rear end side of the cylindrical hole 6*b* (that is, the space S' formed in the rear end side of the direct contacting structure a) is formed in the axial direction to at least one of the sliding surfaces 5*a* and 6*a*.

Moreover, the communicating slot 18 is filled with grease as a lubricant.

In addition, the time when the starter is driven means the time when the pinion 7 is already meshed with a ring gear G of an engine (refer to FIG. 1), and the torque generated by the motor 2 is transmitted to the ring gear G from the pinion 7 to crank (start) the engine.

As shown in FIG. 1, a lever engaging portion 19 that engages with an end of the shift lever 8 is disposed to an end in the rear end side of the main tube body 6A.

Moreover, a sealing member 20 that prevents intrusion of foreign substances from the outside to the front end side of the bearing 16 is disposed in a perimeter of the main tube body 6A.

The sealing member 20 is an oil seal made of rubber, for example, and is held at the housing 17 in the state where a lip part of the sealing member 20 is contacted to the outer surface of the main tube body 6A.

An outer diameter of the pinion sliding part 6B is formed smaller than that of the main tube body 6A, and direct spline teeth 6*c* are formed in the outer surface in the axial direction (refer to FIG. 2).

The pinion 7 is formed separately with the pinion tube 6 and attached to the pinion sliding part 6B movably in the axial direction relative to the pinion sliding part 6B.

Moreover, the pinion 7 is energized by a pinion spring 21 to the front end side of the pinion sliding part 6B, and movement in the axial direction is suppressed by a pinion stopper 22 attached to the end in the front end side of the pinion sliding part 6B.

Further, as shown in FIGS. 2A and 2B, the pinion 7 has a slide hole 7*b* and a large hole 7*c*. The slide hole 7*b* opens to the inner circumference in the front end side of the pinion 7 and direct spline slots 7*a* are formed in the inner surface in the axial direction. The large hole 7*c* communicates with the slide hole 7*b* and opens to the inner circumference in the rear end side of the pinion 7, while an inner diameter of the large hole 7*c* is formed larger than that of the slide hole 7*b*.

Furthermore, the pinion sliding part 6B is inserted into the inner circumference of the slide hole 7*b* through the inner circumference of the large hole 7*c*, and the direct spline teeth 6*c* mesh with the direct spline slots 7*a*, so that the pinion 7 is attached to the pinion sliding part 6B movably in the axial direction relative to the pinion sliding part 6B.

Moreover, in the pinion 7, the perimeter of the end in the front end side of the main tube body 6A is meshed with the inner circumference of the end in the rear end side of the large hole 7*c*.

The pinion spring 21 is arranged between a stepped surface formed between the main tube body 6A of the pinion tube 6 and the pinion sliding part 6B in the radial direction, and a stepped surface formed between the large hole 7*c* of the pinion 7 and the slide hole 7*b* in the radial direction.

As shown in FIG. 1, the electromagnetic switch 9 has a solenoid SL (electromagnetic solenoid of the present disclosure) that drives a plunger 23 by the attraction force of the electromagnet, and a resin cover 24 that has the main point of contact disposed therein. The resin cover 24 is fixed by crimping to an opening end of a frame that serves as a magnetic circuit of solenoid SL.

The solenoid SL includes an exciting coil 25, the plunger 23, a return spring 26, a drive spring 27, and a joint 28 etc.

The exciting coil 25 forms the electromagnet by energizing, and the plunger 23 is arranged in the inner circumference of the exciting coil 25 movably in the axial direction.

The return spring 26 pushes back the plunger 23 when the energizing to the exciting coil 25 is stopped and the attraction force of the electromagnet disappears and the drive spring 27 conserves a reaction force for meshing the pinion 7 to the ring gear G of the engine.

The joint 28 transmits a motion of the plunger 23 to the shift lever 8 via the drive spring 27.

The main point of contact has a set of fixed contacts (not shown) connected to a power supply line of the motor 2 through two terminal bolts 29 and 30 fixed to the resin cover 24, and a moving contact (not shown) that is interlocked with the motion of the plunger 23 and electrically intermits between the set of fixed contacts.

The main point of contact closes when the plunger 23 is attracted by the electromagnet and moves to the right in FIG. 1, and the moving contact contacts to the set of fixed contacts so that the set of fixed contacts is closed, while the main point of contact opens when the attraction force of the electromagnet disappears and the plunger 23 is pushed back by the return spring 26, and the moving contact separates from the set of fixed contacts so that the fixed contacts are closed.

The shift lever 8 has a lever fulcrum part 8*a* supported rotatably by the housing 17, and one end of the lever is connected with the joint 28 of the electromagnetic switch 9 while another end of the lever is engaged with the lever engaging portion 19 attached to the main tube body 6A.

Next, the operation of the starter 1 is explained.

When a starter switch (not shown) is closed by a user, the exciting coil 25 of the electromagnetic switch 9 is energized from a battery and the electromagnet is formed, is thus the plunger 23 moves by the attraction force of the electromagnet.

The pinion tube 6 is pushed out together with the pinion 7 in the anti-motor side direction by the motion of the plunger 23 being transmitted to the pinion tube 6 via the shift lever 8.

At this time, if the pinion 7 does not mesh with the ring gear G and an end surface of the pinion 7 contacts an end surface of the ring gear G, movement of the pinion 7 stops, and only the pinion tube 6 is pushed out pushing and contracting the pinion spring 21.

Then, if the plunger 23 further moves storing reaction force in the drive spring 27 and closes the main point of contact, torque is generated by the motor 2 in response to the electric power supply from the battery.

After being amplified by the speed reducer 3, the torque generated in the motor 2 is transmitted to the output shaft 5 via the clutch 4, and further transmitted to the pinion tube 6 from the output shaft 5, so that the pinion tube 6 rotates.

When the pinion 7 rotates to the position where meshing with the ring gear G becomes possible by the rotation of the pinion tube 6, the pinion tube 6 is pushed out by the reaction force stored in the drive spring 27 and a thrust (forwarding force) in the axial direction generated by exchanging the torque generated by the motor 2 by the male and the female helical splines 5*a* and 6*a*.

Furthermore, the meshing of the pinion 7 and the ring gear G is completed by the pinion 7 being pushed out by the reaction force of the pinion spring 21.

Thereby, the torque generated by the motor 2 is transmitted to the ring gear G from the pinion 7, and cranks (starts) the engine.

When the starter switch is opened by the user after the engine has started by cranking, the plunger 23 is pushed back by the reaction force of the return spring 26 because the energizing to the exciting coil 25 is stopped and the attraction force of the electromagnet has disappeared.

As a result, the main point of contact opens and the energizing to the motor 2 from the battery is stopped, and rotation of the armature slows down gradually and finally stops.

Moreover, when the plunger 23 is pushed back, the shift lever 8 swings to an opposite direction to a direction at the time of starting the engine and pushes back the pinion tube 6 in the motor side direction, so that the pinion 7 separates from the ring gear G and moves back together with the pinion tube 6 to produce the stopped condition of the starter 1 shown in FIG. 2A.

Function and Effect of the Present Embodiment

In the starter 1 shown in the present embodiment, the pinion sliding part 6B is formed on the end in the front end side of the pinion tube 6 supported by the housing 17 through the bearing 16, and the pinion 7 is meshed in a direct spline fitting manner to the perimeter of the pinion sliding part 6B and attached thereto.

That is, the starter 1 is a cantilever structure that does not have a bearing that supports the pinion tube 6 in to the front end side from the pinion 7.

In the starter 1, the pinion tube 6 is attached to the perimeter of the output shaft 5 by helical spline fitting, and is pushed out by the electromagnetic switch 9 in the anti-motor side direction relative to the output shaft 5 when starting the engine.

Moreover, the end in the rear end side of the output shaft 5 is disposed together with the inner 4*b* of the clutch 4.

According to this composition, the output shaft 5 and the clutch 4 do not move when starting the engine.

Moreover, since the pinion tube 6 is attached to the perimeter of the output shaft 5 by helical spline fitting and attached movably in the axial direction relative to the output shaft 5, the main tube body 6A is formed in a hollow shape.

Thereby, the weight of the pinion tube 6 can be reduced.

Figure 6:
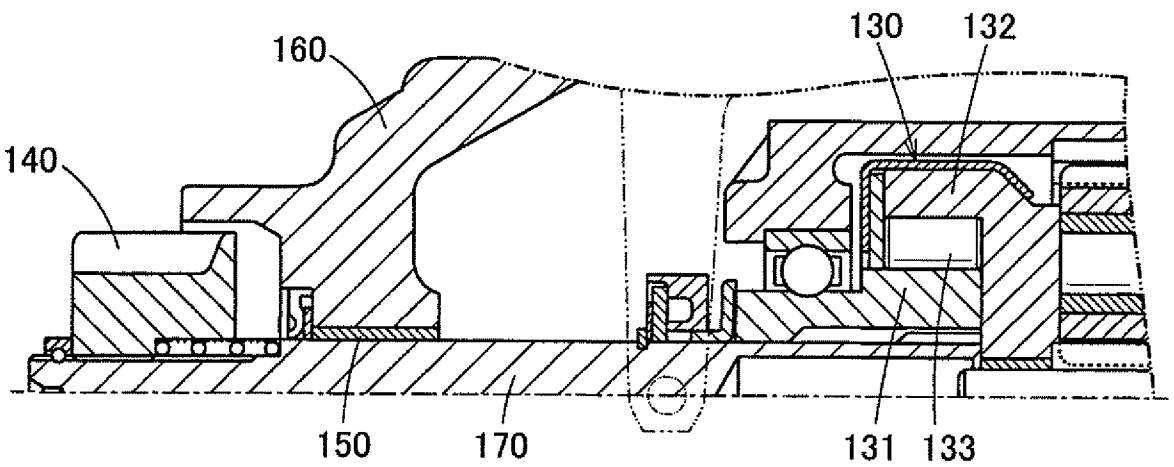
FIG.6 PRIOR ART
FIG. 6 shows a block diagram of a principal part of a starter disclosed in Japanese Patent Application Laid-Open Publication No. 2007-146759.

On the other hand, the pinion shaft 170 used for the starter of '759 shown in FIG. 6 is attached to the inner circumference of the inner tube 131 by helical spline fitting.

Therefore, if the pinion shaft 170 is formed in a hollow shape, there is a possibility that the pinion shaft 170 lacks rigidity.

That is, since there are no parts that support the pinion shaft 170 from the inner surface even if the pinion shaft 170 is formed in the hollow shape, it is difficult to form the pinion shaft 170 in the hollow shape in order to reduce its weight.

Accordingly, since the masses of moving bodies including the pinion tube 6 and the pinion 7 can be made small in the starter 1 of the present embodiment, the electromagnetic switch 9 that generates the attraction force for pushing out moving bodies via the shift lever 8 can be miniaturized.

Furthermore, the starter 1 of the present embodiment does not have the structure that the inner 4*b* of the clutch 4 meshes with the output shaft 5 gears by helical spline fitting, but the rear end of the output shaft 5 is formed together with the inner 4*b* of the clutch 4.

In this case, the clearances (clearance that occurs between the outer 4*a* and the roller 4*c* and the clearance that occurs between the roller 4*c* and inner 4*b*) that occur in the clutch 4 and the clearance that occurs between the male helical spline 5*a* formed in the output shaft 5 and the female helical spline 6*a* formed in the pinion tube 6 do not overlap in the axial direction.

In other words, since the clearances that occur in the clutch 4 and the clearance that occurs in the spline part are separated in the axial direction, inclination of the pinion tube 6 can be suppressed.

As a result, since wear of the bearings 10 and 16 that support the pinion tube 6 and the gears 3*a*, 3*b*, and 3*c* that constitute the speed reducer 3 can be suppressed, the life of the starter 1 can be extended.

Moreover, the pinion 7 is formed separately with the pinion tube 6, attached movably in the axial direction relative to the pinion sliding part 6B, and is energized by the pinion spring 21 to the front end side.

According to this composition, when the pinion 7 is rotated by the rotation of the motor 2 to the position where the pinion 7 can mesh with the ring gear G after the pinion pushed out by the electromagnetic switch 9 in the anti-motor side direction together with the pinion tube 6 contacts the end face of the ring gear G, the pinion 7 can be selectively pushed out without moving other unnecessary components by the reaction force of the pinion spring 21 thus the ease of engagement of the pinion 7 and the ring gear G may be improved.

Moreover, by forming the large hole 7*c* in the inner circumference in the rear end side of the pinion 7, the pinion spring 21 can be arranged to the space formed between the large hole 7*c* and the outer surface of the pinion sliding part 6B, and the perimeter of the end in the front end side of the main tube body 6A is fit into the inner circumference of the end in the rear end side of the large hole 7*c*, thus the pinion spring 21 is not exposed directly to outside.

Thereby, an environmental resistance of the pinion spring 21 can be secured and performance degradation can be suppressed.

Furthermore, the communicating slot 18 is formed on at least one of the sliding surfaces 5*a* and 6*a* in the output shaft 5 and the pinion tube 6.

Since the communicating slot 18 is communicating with the space S in the tip side formed inside of the pinion tube 6 and space S' in the rear end side, load being applied to the pinion tube 6 can be made small when the pinion tube 6 moves in the axial direction relative to the output shaft 5.

That is, assuming that the space S mentioned above is substantially sealed, when the pinion tube 6 is pushed out when the starter 1 is stopped, a capacity of the space S becomes large and air inside the space S expands, hence internal pressure drops.

On the other hand, when the pinion tube 6 is pushed back when the starter 1 is driven, the capacity of the space S becomes small and the air inside the space S is compressed, hence internal pressure rises.

A change of internal pressure acts as load when the pinion tube 6 moves in the axial direction.

By contrast, since the air can move easily through the communicating slot 18 between the space S and space S' when the pinion tube 6 moves in the axial direction by forming the communicating slot 18 that communicates the space S and space S', the load being applied to the pinion tube 6 becomes small.

As a result, the pinion tube 6 can be moved more smoothly.

Moreover, the output shaft 5 is supported by the pinion tube 6 using to a direct contacting structure a that outer surfaces other than the male helical spline 5*a* and inner surfaces other than the female helical spline 6*a* of the pinion tube 6 contact directly.

Thereby, the output shaft 5 can be supported by the pinion tube 6 without other parts, such as bearings.

As a result, in supporting the output shaft 5 by the pinion tube 6, *a* clearance that occurs in the radial direction can be limited to the radial direction clearance Z formed between the sliding surface 5*a* that is the outer surfaces of the output shaft 5 and the sliding surface 6*a* that is the inner surfaces of the pinion tube 6.

For this reason, the radial direction clearance Z can be configured to be small and the inclination of the pinion tube 6 or the pinion 7 relative to the output shaft 5 can be suppressed.

As a result, wear of gears 3*a*-3*c* that constitutes the bearings 10 and 16 and the speed reducer 3 is suppressed, and this can contribute to improvement in the life of the starter 1.

Moreover, the output shaft 5 can be supported by the pinion tube 6 by both meshing of the male and the female helical splines 5*a* and 6*a* and the direct contacting structure a.

For this reason, since the inclination of the pinion tube 6 and the pinion 7 relative to the output shaft 5 can further be suppressed, the life of the starter 1 can be extended further.

Moreover, the distances X1 and X2 between the teeth in the inner surface and the outer surface are smaller than the backlash Y between the male helical spline 5*a* and the female helical spline 6*a* in the circumferential direction, and the radial direction clearance Z in the direct contacting structure a is smaller than the distances X1 and X2 between the teeth in the inner surface and the outer surface (refer to FIG. 3).

Thereby, when the pinion tube 6 inclines relative to the output shaft 5, regarding a contact between the male and the female helical splines 5*a* and 6*a*, a contact of a tooth tip and a tooth bottom precedes a contact of teeth surfaces.

For this reason, the inclination of the pinion tube 6 relative to the output shaft 5 can be suppressed, and the life improvement effect of the starter 1 can be enhanced.

Moreover, since contacting areas of the teeth surfaces can be increased, an adhesion of the teeth surfaces can be suppressed.

Furthermore, by making the radial direction clearance Z smaller than the distances X1 and X2 between the teeth in the inner surface and the outer surface, the inclination of the pinion tube 6 relative to the output shaft 5 can further be suppressed, and the life improvement effect of the starter 1 can be enhanced.

Moreover, the sliding surface 6*a* in the pinion tube 6 side that forms the direct contacting structure a is formed in the front end side of the female helical spline 6*a*, and the sliding surface 5*a* in the output shaft 5 side that forms the direct contacting structure a is formed in the front end side of the male helical spline 5*a*.

Thereby, the radial direction clearance Z smaller than the distance X1 and X2 between the teeth in the inner surface and the outer surface can be formed in the front end side near the pinion 7 in the axial direction, so that the pinion tube 6 can support the output shaft 5.

For this reason, even if the ring gear G meshes with the pinion 7 and a large load is applied to the pinion 7, the inclination of the pinion tube 6 relative to the output shaft 5 can be suppressed.

Moreover, the diameter of the tooth bottom of the male helical spline 5*a* is smaller than that of the sliding surface 5*a* in the output shaft 5 side that forms the direct contacting structure a (refer to FIG. 4A).

Figure 4B:
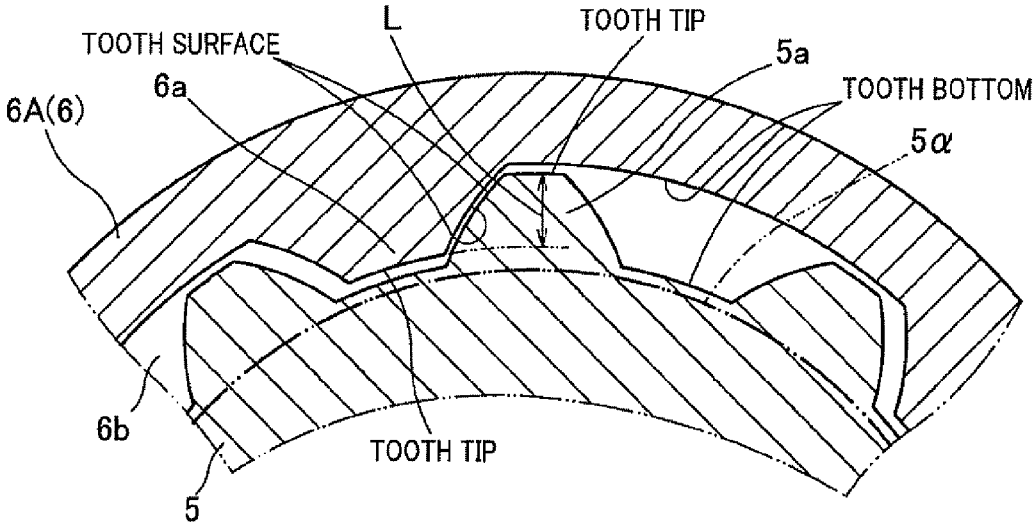
FIG. 4B shows a diagram showing a spatial relationship between an outer surface of an output shaft and a tooth bottom of a male spline in the radial direction that forms the direct contacting structure of a comparative example relative to the present disclosure.
Figure 5:
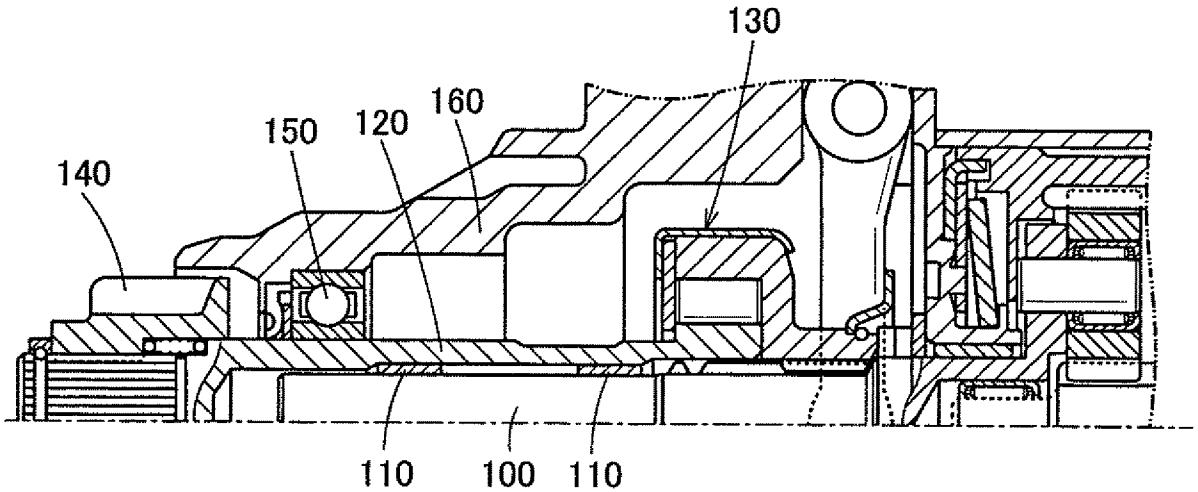
FIG.5 PRIOR ART
FIG. 5 shows a block diagram of a principal part of a starter disclosed in Japanese Patent Application Laid-Open Publication No. 2006-177168.

Thereby, as shown in FIG. 4B for example, compared with the case where the diameter of the sliding surface 5*a* is smaller than that of the tooth bottom of the male helical spline 5*a*, an overlapping length L of the male and the female helical splines 5*a* and 6*a* in the radial direction can be lengthened by lengthening the teeth length of the male and the female helical splines 5*a* and 6*a*.

For this reason, a surface pressure that acts between teeth surfaces can be reduced, and a possibility of adhesion can be reduced.

Moreover, the communicating slot 18 is formed on at least one of the sliding surfaces 5*a* and 6*a* that form the direct contacting structure a, and the communicating slot 18 is filled with grease.

Thereby, lubricity is maintainable regarding the slide of the pinion tube 6 relative to the output shaft 5.

In addition, in order to spread grease in the radial direction clearance Z more broadly, the communicating slot 18 may be bent to curve profiles, such as a helical shape.

[Modification]

The aspect of the starter 1 is not limited to the present embodiment, but various modifications can be considered.

For example, according to the starter 1 of the present embodiment, both the distances X1 and X2 between the teeth in the inner surface and the outer surface are smaller than the backlash Y between the male helical spline 5*a* and the female helical spline 6*a* in the circumferential direction.

However, only one of the distances X1 and X2 between the teeth in the inner surface and the outer surface may be smaller than the backlash Y and the other one may be longer than the backlash Y.

The clutch 4 used in the present embodiment s a roller type clutch that uses the rollers 4*c* as the power intermittence member.

However, a sprag type clutch using a sprag as a power intermittence member or a cam type clutch using a cam as a power intermittence member may be used replacing the rollers 4*c*.

Moreover, the motor 2 used for the starter 1 is not limited to the direct-current (DC) commutator motor 2 as in the present embodiment, but an alternating-current (AC) motor can also be used, for example.

The pinion 7 is formed separately with the pinion tube 6 and is meshed in a direct spline fitting manner to the perimeter of the pinion sliding part 6B in the present embodiment.

However, the pinion 7 and the pinion tube 6 may be formed unitarily.

The electromagnetic switch 9 of the present embodiment drives the shift lever 8 and closes the main point of contact by the movement of the plunger 23 attracted by the electromagnet.

However, an action that drives the shift lever 8 and pushes out the pinion tube 6 in the anti-motor side direction, and an action that opens and closes the main point of contact may be performed by a separate solenoid.

Namely, an electromagnetic switch of tandem structure with a pinion extrusion solenoid (electromagnetic solenoid of the present disclosure) for driving the shift lever 8 to push out the pinion tube 6 in the anti-motor side direction and a motor energizing solenoid that opens and closes the main point of contact to intermit an energizing current of the motor 2 may be used.

Furthermore, both the pinion extrusion solenoid and the motor energizing solenoid may be accommodated in a common frame to constitute them as a single electromagnetic switch.

However, both solenoids may also be accommodated independently in exclusive frames.

The electromagnetic switch of tandem structure can control independently the operation of the pinion extrusion solenoid and the operation of the motor energizing solenoid by an ECU, and therefore may be adopted suitably to a ISS (idling stop system) that has been employed in vehicles in recent years.

What is claimed is:

1. A starter comprising:

a motor that generates torque;

an output shaft disposed coaxially with a rotating shaft of the motor and a male spline is formed on an outer surface thereof;

a clutch that transmits the torque generated by the motor to the output shaft;

a pinion tube that has a cylindrical hole where a female spline is formed in an inner surface thereof and an anti-motor side in an axial direction of the output shaft is inserted into an inner circumference of the cylindrical hole so that the male spline and the female spline are meshed;

a pinion disposed on an end of the pinion tube in the anti-motor side in the axial direction and rotates together with the pinion tube; and an electromagnetic solenoid that drives a shift lever by an attraction force of an electromagnet and pushes out the pinion tube together with the pinion in the anti-motor side direction relative to the output shaft via the shift lever; wherein, the pinion is engaged with a ring gear of an engine by pushing out the pinion tube in the anti-motor side direction relative to the output shaft by an operation of the electromagnetic solenoid; and the output shaft is supported by the pinion tube according to a direct contacting structure that outer surfaces other than the male spline and inner surfaces other than the female spline of the pinion tube contact directly.

2. The starter according to claim 1, wherein, when a distance between a tooth tip of the male spline and a tooth bottom of the female spline in a radial direction is defined as a distance between teeth in an outer surface, and a distance between a tooth bottom of the male spline and a tooth tip of the female spline in a radial direction is defined as a distance between teeth in an inner surface, at least one of, the distances between the teeth is smaller than a backlash between the male spline and the female spline in a circumferential direction; and a clearance in a radial direction between the inner surface of the pinion tube and the outer surface of the output shaft is configured smaller than both the distances between the teeth in the outer surface and the inner surface.

3. The starter according to claim 2, wherein, the inner surface of the pinion tube is formed in the anti-motor side in the axial direction of the female spline, and the outer surface of the output shaft is formed in the anti-motor side in the axial direction from the male spline.

4. The starter according to claim 1, wherein, a diameter of the tooth bottom of the male spline is smaller than that of the outer surface of the output shaft.

5. The starter according to claim 2, wherein, a diameter of the tooth bottom of the male spline is smaller than that of the outer surface of the output shaft.

6. The starter according to claim 3, wherein, a diameter of the tooth bottom of the male spline is smaller than that of the outer surface of the output shaft.

7. The starter according to claim 1, wherein, a slot where lubricant is filled is formed on at least one of the outer surface of the output shaft and the inner surface of the pinion tube.

8. The starter according to claim 2, wherein, a slot where lubricant is filled is formed on at least one of the outer surface of the output shaft and the inner surface of the pinion tube.

9. The starter according to claim 3, wherein, a slot where lubricant is filled is formed on at least one of the outer surface of the output shaft and the inner is surface of the pinion tube.

10. The starter according to claim 4, wherein, a slot where lubricant is filled is formed on at least one of the outer surface of the output shaft and the inner surface of the pinion tube.

11. The starter according to claim 5, wherein, a slot where lubricant is filled is formed on at least one of the outer surface of the output shaft and the inner surface of the pinion tube.

12. The starter according to claim 6, wherein, a slot where lubricant is filled is formed on at least one of the outer surface of the output shaft and the inner surface of the pinion tube.

* * * * *